US012091837B2

(12) United States Patent
Imura et al.

(10) Patent No.: US 12,091,837 B2
(45) Date of Patent: Sep. 17, 2024

(54) WORK MACHINE

(71) Applicant: Hitachi Construction Machinery Co., Ltd., Tokyo (JP)

(72) Inventors: Shinya Imura, Tsuchiura (JP); Yoshiyuki Tsuchie, Tokyo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 295 days.

(21) Appl. No.: 17/638,303

(22) PCT Filed: Sep. 14, 2020

(86) PCT No.: PCT/JP2020/034621
§ 371 (c)(1),
(2) Date: Feb. 25, 2022

(87) PCT Pub. No.: WO2021/065429
PCT Pub. Date: Apr. 8, 2021

(65) Prior Publication Data

US 2022/0349151 A1 Nov. 3, 2022

(30) Foreign Application Priority Data

Sep. 30, 2019 (JP) ..... 2019-178373

(51) Int. Cl.
*E02F 9/24* (2006.01)
*E02F 9/20* (2006.01)
*E02F 9/26* (2006.01)

(52) U.S. Cl.
CPC ..... *E02F 9/2033* (2013.01); *E02F 9/24* (2013.01); *E02F 9/261* (2013.01); *E02F 9/262* (2013.01)

(58) Field of Classification Search
CPC ..... E02F 9/2025; E02F 9/2033; E02F 9/24; E02F 9/26; E02F 9/261; E02F 9/262;
(Continued)

(56) References Cited

U.S. PATENT DOCUMENTS

2019/0241124 A1* 8/2019 Izumikawa ..... B60R 11/04
2020/0032489 A1* 1/2020 Yamazaki ..... G05D 1/021

FOREIGN PATENT DOCUMENTS

CN 109072589 A 12/2018
JP 2007-85091 A 4/2007
(Continued)

OTHER PUBLICATIONS

International Search Report (PCT/ISA/210) issued in PCT Application No. PCT/JP2020/034621 dated Nov. 24, 2020 with English translation (five (5) pages).
(Continued)

*Primary Examiner* — Spencer D Patton
(74) *Attorney, Agent, or Firm* — Crowell & Moring LLP

(57) ABSTRACT

Provided is a work machine capable of eliminating the inconvenience from the operator of the work machine as much as possible while deterring a contact between the work machine and workers, and suppressing a decrease in productivity of the work machine. A work machine 5 includes: an identification information recognition device 41 configured to recognize identification information on a person who enters a predetermined region R around the work machine 5; and a controller 7 configured to control the work machine in accordance with the identification information. When a person enters the predetermined region R under the condition that the work machine 5 is ready for operation, the controller 7 counts the number of times the person enters the predetermined region R as the number of approaches for each person distinguished with the identification information, and controls the work machine 5 based on the counted number of approaches in accordance with the identification information of the person who is in the predetermined region R.

11 Claims, 11 Drawing Sheets

(58) Field of Classification Search
CPC ..... G08B 21/0261; G08B 21/0266; B25J 9/1674; B25J 9/1676
See application file for complete search history.

(56) References Cited

FOREIGN PATENT DOCUMENTS

| | | | | |
|---|---|---|---|---|
| JP | 2007085091 | A | * | 4/2007 |
| JP | 2010-198519 | A | | 9/2010 |
| JP | 2014-177790 | A | | 9/2014 |
| JP | 2016-176289 | A | | 10/2016 |
| JP | 2017-82430 | A | | 5/2017 |
| JP | 2019-19523 | A | | 2/2019 |
| JP | 2019-56301 | A | | 4/2019 |
| WO | WO 2018/084161 | A1 | | 5/2018 |

OTHER PUBLICATIONS

Japanese-language Written Opinion (PCT/ISA/237) issued in PCT Application No. PCT/JP2020/034621 dated Nov. 24, 2020 (five (5) pages).
Chinese-language Office Action issued in Chinese Application No. 202080060021.6 dated Oct. 11, 2022 (two (2) pages).

* cited by examiner

| Number of approaches output from counter | 0 | Small | Medium | Large |
|---|---|---|---|---|
| Alarm magnitude | None | Small | Medium | Large |

| Number of approaches output from counter | 0 | Small | Medium | Large |
|---|---|---|---|---|
| Alarm generated | No | No | Yes | Yes |

FIG. 10

| | | Number of approaches output from counter | | | |
|---|---|---|---|---|---|
| | | 0 | Small | Medium | Large |
| Approach distance | Very short | Alarm: No | Alarm: medium | Alarm: large | Alarm: large |
| | Short | | Alarm: small | Alarm: medium | Alarm: large |
| | Normal | | Alarm: small | Alarm: small | Alarm: medium |

FIG. 11

| | | Number of approaches output from counter | | | |
|---|---|---|---|---|---|
| | | 0 | Small | Medium | Large |
| Approach distance | Very short | Alarm: No | Alarm: Yes | Alarm: Yes | Alarm: Yes |
| | Short | | Alarm: No | Alarm: Yes | Alarm: Yes |
| | Normal | | Alarm: No | Alarm: No | Alarm: Yes |

FIG. 14

| Number of approaches output from counter | 0 | Small | Medium | Large |
|---|---|---|---|---|
| Reduction in operating speed | None | Small | Medium | Large |

FIG. 15

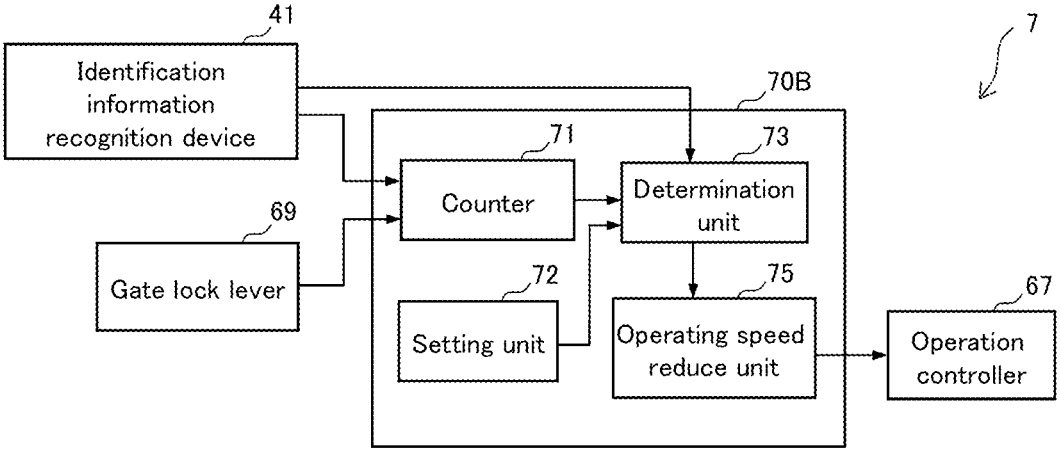

FIG. 16

| | | Number of approaches output from counter | | | |
|---|---|---|---|---|---|
| | | 0 | Small | Medium | Large |
| Approach distance | Very short | Reduction: None | Reduction: medium | Reduction: large | Reduction: large |
| | Short | | Reduction: small | Reduction: medium | Reduction: large |
| | Normal | | Reduction: small | Reduction: small | Reduction: medium |

FIG. 17
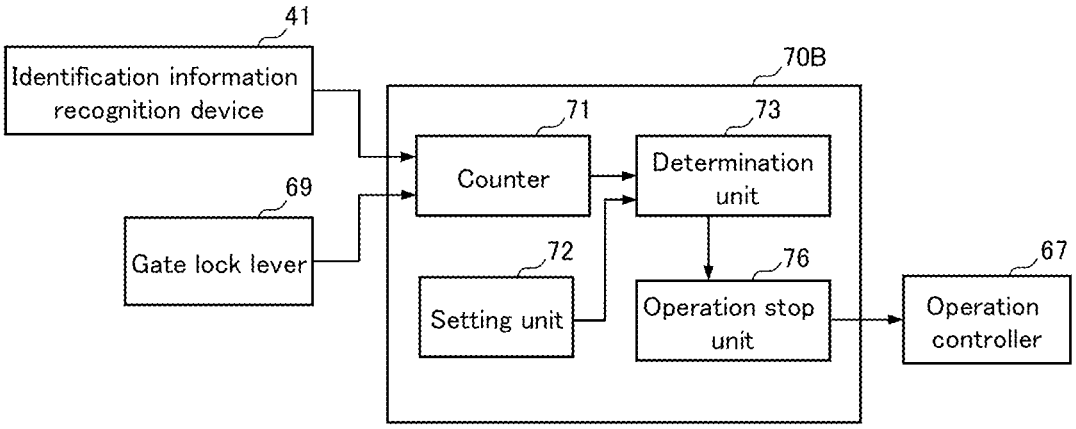
FIG. 18
| Number of approaches output from counter | 0 | Small | Medium | Large |
|---|---|---|---|---|
| Operation stopped | No | No | Yes | Yes |
FIG. 19
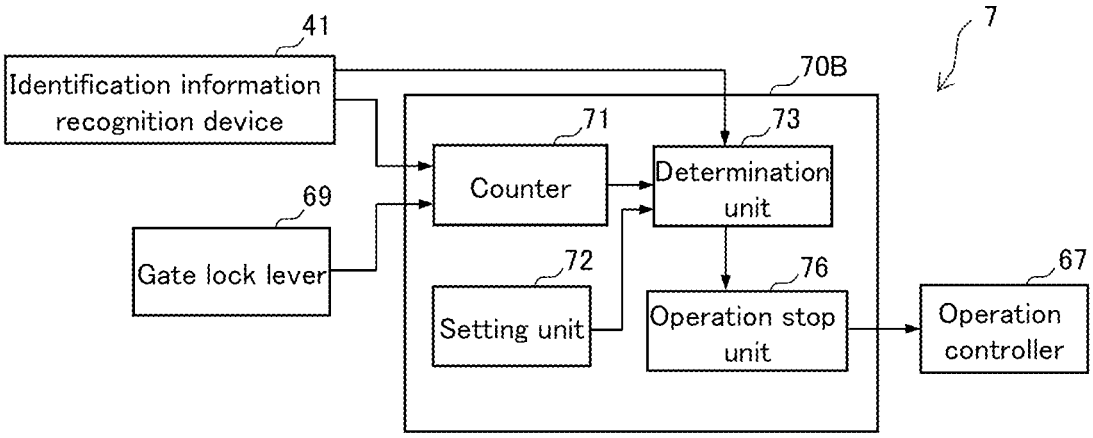

FIG. 20

| | | Number of approaches output from counter | | | |
|---|---|---|---|---|---|
| | | 0 | Small | Medium | Large |
| Approach distance | Very short | Stop: No | Stop: Yes | Stop: Yes | Stop: Yes |
| | Short | | Stop: No | Stop: Yes | Stop: Yes |
| | Normal | | Stop: No | Stop: No | Stop: Yes |

FIG. 21

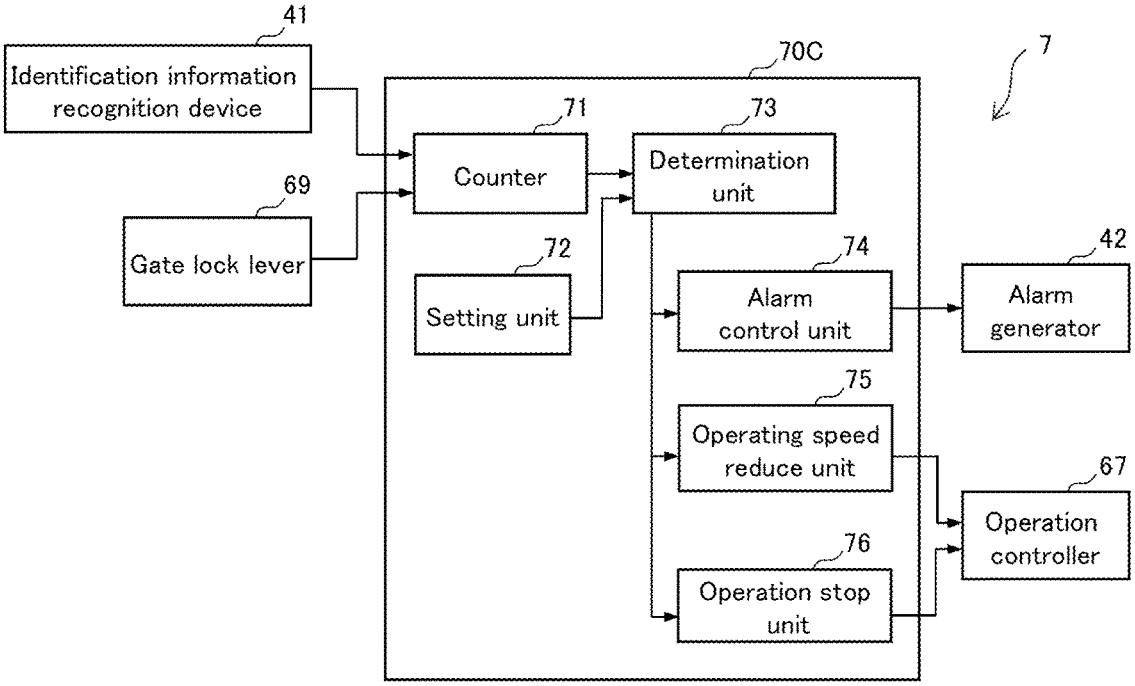

FIG. 22

| | | Number of approaches output from counter | | | |
|---|---|---|---|---|---|
| | | 0 | Small | Medium | Large |
| Approach distance | Very short | None | Stop: Yes | Stop: Yes | Stop: Yes |
| | Short | | Reduction: small | Reduction: medium | Reduction: large |
| | Normal | | Alarm: small | Alarm: medium | Alarm: large |

WORK MACHINE

TECHNICAL FIELD

The present invention relates to work machines such as hydraulic excavators, bulldozers, wheel loaders, compaction machines, and trucks.

BACKGROUND ART

Conventionally, work machines may issue an alarm or may stop during operation when a person approaches the work machine. Patent Literature 1, for example, proposes a work machine that shortens an alarm or the distance to stop the work machine if a person entering the work site is a worker at the work site, as compared with a person who is not a worker.

CITATION LIST

Patent Literature

Patent Literature 1: JP 2017-82430 A

SUMMARY OF INVENTION

Technical Problem

However, some workers are careful, while others are careless. Even if careless workers are away from the work machine, they are more likely to come into contact with the work machine depending on their subsequent actions. In contrast, careful workers are often safe even when they are relatively close to the work machine.

The work machine of Patent Literature 1 issues an alarm or controls the stopping of the work machine for all workers based on the distance of the workers from the work machine regardless of whether they are careless workers or careful workers. The operator of this work machine may find such process annoying.

Specifically, if a long distance for careless workers is applied to this control, the control may be performed often to careful workers also. In this case, the operator of the work machine may feel annoyed and the productivity of the work machine may deteriorate.

In contrast, if a short distance for careful workers is applied, the safety management for careless workers will be insufficient. In that case, the operator of the work machine is required to operate the work machine while being concerned about the behavior of other workers around it. As such, this case also causes the operator of the work machine to feel annoyed and the productivity by the work machine may deteriorate.

In view of these points, the present invention provides a work machine capable of eliminating the inconvenience from the operator of the work machine while deterring a contact between the work machine and other workers working around it, and suppressing a decrease in productivity of the work machine.

Solution to Problem

In view of this, a work machine according to the present invention includes: an identification information recognition device configured to recognize identification information on a person who enters a predetermined region around the work machine; and a controller configured to control the work machine. When a person enters the predetermined region under the condition that the work machine is ready for operation, the controller counts the number of times the person enters the predetermined region as the number of approaches for each person distinguished with the identification information, and the controller controls the work machine based on the counted number of approaches in accordance with the identification information of the person who is in the predetermined region.

Advantageous Effects of Invention

When a person enters a predetermined region, the present invention counts the number of times (number of approaches) each person, distinguished with identification information, entered the predetermined region. This allows the recognition whether the person in the region R is a careful worker or a careless worker according to the counted number of approaches. The present invention controls the work machine based on the counted number of approaches, and so controls the work machine depending on whether the worker is a careful worker or a careless worker. As such, the present invention eliminates the inconvenience from the operator of the work machine as much as possible while deterring a contact between the work machine and workers, and suppresses a decrease in productivity of the work machine.

BRIEF DESCRIPTION OF DRAWINGS

FIG. 10 shows the number of approaches and the approach distance versus the magnitude of alarm, set by the setting unit shown in FIG. 9.

FIG. 11 shows a modified example of the setting unit of FIG. 8.

FIG. 14 shows the relationship between the reduction in operating speed of the work machine and the number of approaches, set by the setting unit shown in FIG. 13.

FIG. 15 is a block diagram of the controller of the work machine according to a fourth embodiment.

FIG. 16 shows the reduction in operating speed of the work machine versus the number of approaches and the approach distance, set by the setting unit shown in FIG. 15.

FIG. 17 is a block diagram of a controller of a work machine according to a fifth embodiment.

FIG. 18 shows the relationship between the number of approaches and whether or not to stop the operation of the work machine, set by the setting unit shown in FIG. 17.

FIG. 19 is a block diagram of a controller of a work machine according to a sixth embodiment.

FIG. 20 shows the number of approaches and the approach distance versus whether or not to stop the operation of the work machine, set by the setting unit shown in FIG. 19.

FIG. 21 is a block diagram of a controller of a work machine according to a seventh embodiment.

FIG. 22 shows the number of approaches and the magnitude of an alarm versus the number of approaches, the reduction in operating speed of the work machine, and whether or not to stop the operation of the work machine, set by the setting unit shown in FIG. 21.

DESCRIPTION OF EMBODIMENTS

Referring to FIGS. 1 to 22, the following describes some embodiments of a work machine according to the present invention. The following describes a work machine 5 according to some embodiments of the present invention by way of a hydraulic excavator. Note that the work machine according to the present invention is not limited to a hydraulic excavator, which may be general work machines such as bulldozers, wheel loaders, compaction machines, and trucks.

First Embodiment

Work Machine 5

Figure 1:
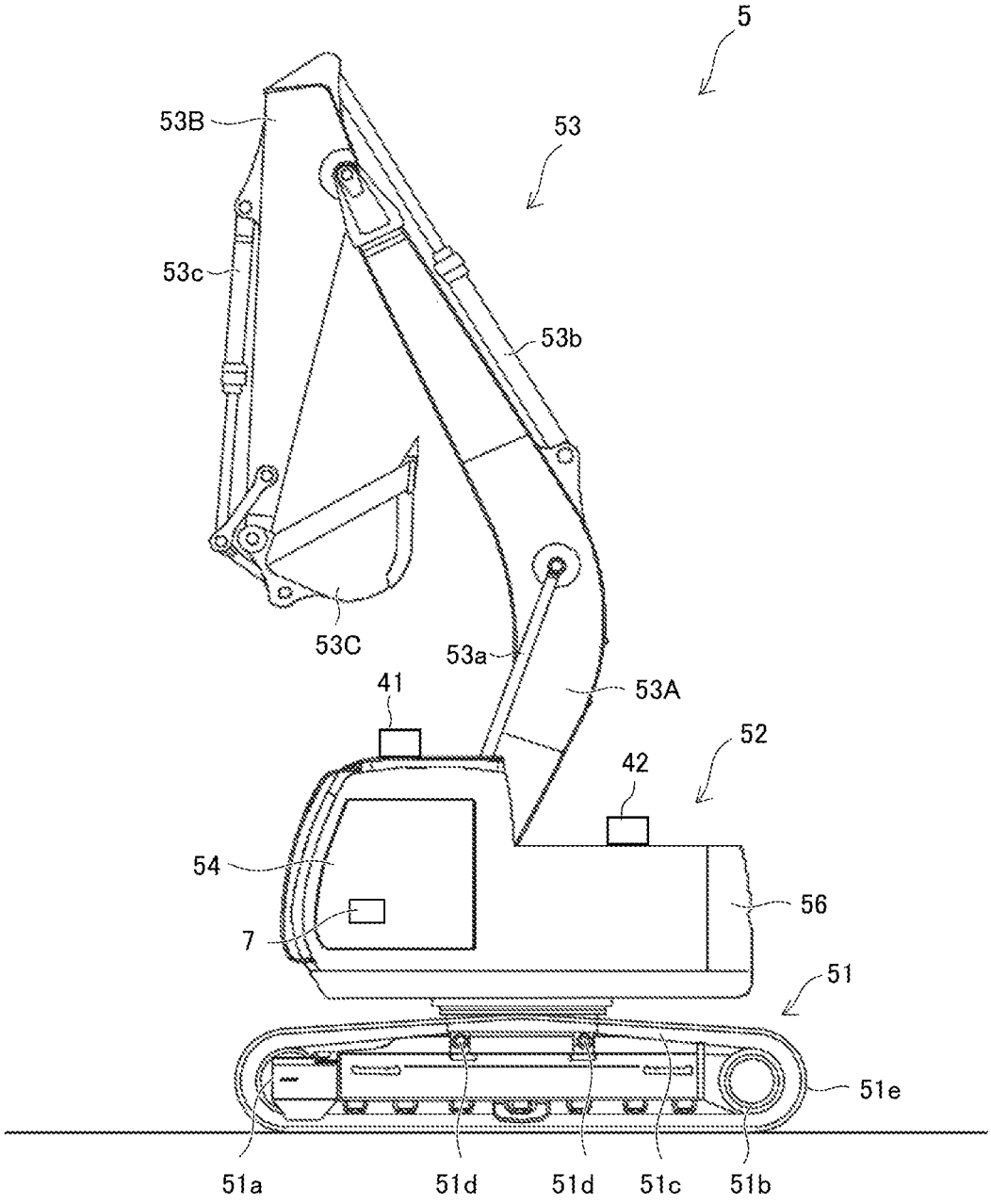
FIG. 1 is one example of a side view showing a work machine according to a first embodiment of the present invention.
Figure 2:
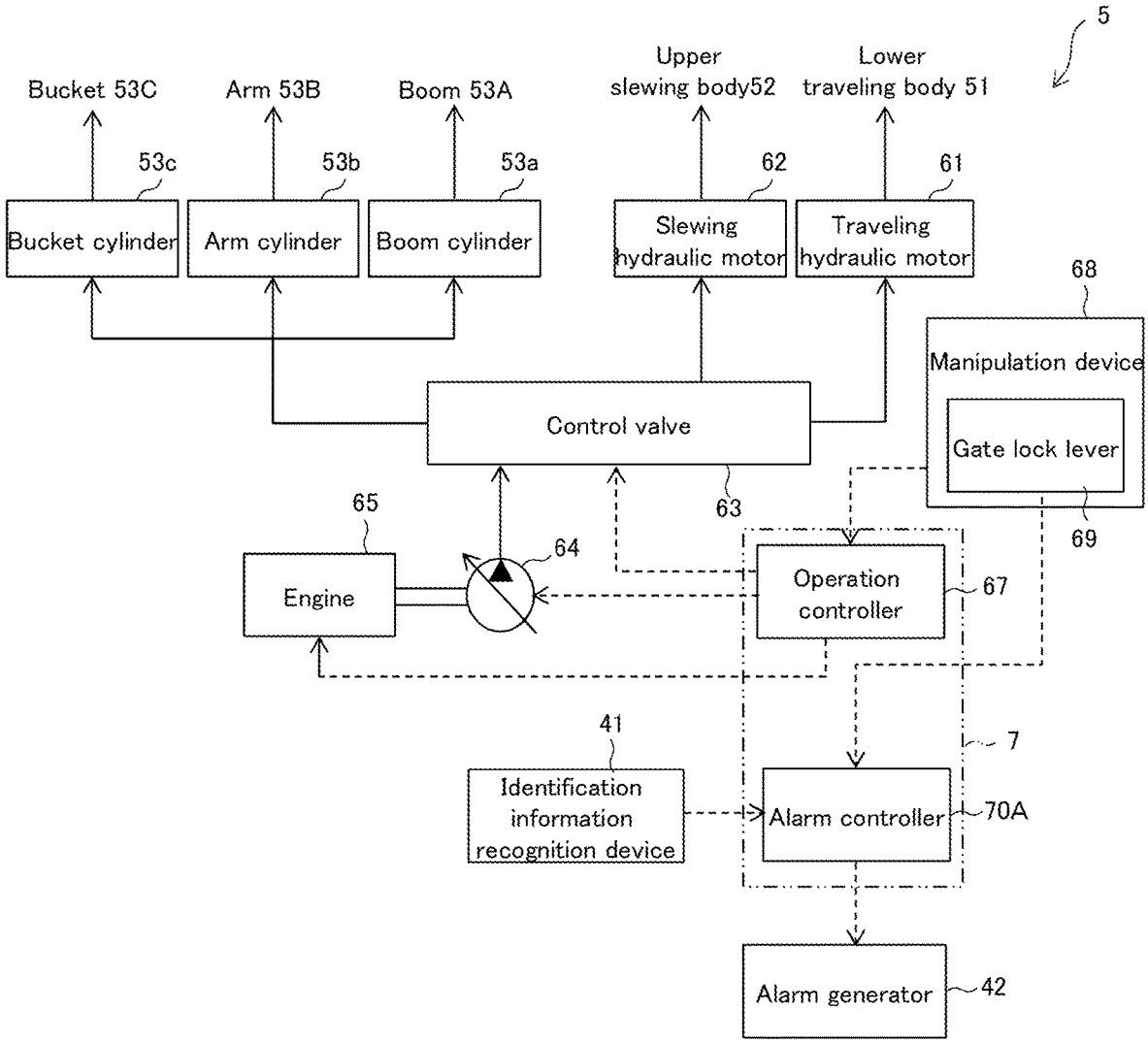
FIG. 2 is a block diagram of the work machine of FIG. 1.

Referring first to FIGS. 1 and 2, the following describes the work machine 5. FIG. 1 is a side view of the work machine 5 according to a first embodiment of the present invention, and FIG. 2 is a block diagram of the work machine 5 of FIG. 1. As shown in FIG. 1, the work machine 5 or the hydraulic excavator includes a crawler-type lower traveling body 51, an upper slewing body 52 mounted above the lower traveling body 51 to be able to swivel, and a multijoint type front working machine 53 attached to the upper slewing body 52.

The lower traveling body 51 includes an idler 51*a* at the front end, and a sprocket 51*b* driven by a traveling hydraulic motor 61 (see FIG. 2) at the rear end. A link (link assembly) 51*c* is bridged between these idler 51*a* and sprocket 51*b*, and rollers 51*d* are placed between the idler 51*a* and the sprocket 51*b* to support the link 51*c*. Attached to the link 51*c* is a shoe plate 51*e* that is installed on the ground. The traveling hydraulic motor 61 is connected to the sprocket 51*b* of the lower traveling body 51 via a decelerator (not shown), for example. Driving the traveling hydraulic motor 61 rotates the sprocket 51*b* of the lower traveling body 51, allowing the work machine 5 to move on uneven ground.

The work machine 5 includes a cabin 54 on either the left or right of the front part of the upper slewing body 52, and includes the front working machine 53 on the right of the cabin 54 and at the front center of the upper slewing body 52 to rotate vertically for excavation and other works. The work machine 5 includes a counterweight 56 at the rear part of the upper slewing body 52 to balance the weight of the machine body. A slewing hydraulic motor 62 (see FIG. 2) is connected between the lower traveling body 51 and the upper slewing body 52 via a decelerator (not shown), for example. Driving the slewing hydraulic motor 62 allows the upper slewing body 52 to slew relative to the lower traveling body 51.

The front working machine 53 includes a boom 53A that is pivotally attached to the upper slewing body 52, an arm 53B that is pivotally attached to the distal end of the boom 53A, and a bucket 53C that is pivotally attached to the arm 53B.

The boom 53A is operated by a hydraulic boom cylinder 53*a* mounted between the boom 53A and the upper slewing body 52. The arm 53B is operated by a hydraulic arm cylinder 53*b* mounted between the boom 53A and the arm 53B. The bucket 53C is operated by a hydraulic bucket cylinder 53*c* mounted between the arm 53B and the bucket 53C. Hereinafter, at least one operation of the boom 53A, the arm 53B, and the bucket 53C is referred to as a front operation of the front working machine 53.

As shown in FIG. 2, the work machine 5 of the present embodiment further includes an engine 65, a hydraulic pump 64 connected to the engine 65, and a control valve 63 connected to the hydraulic pump 64. The hydraulic pump 64 is driven by the output of the engine 65 and boosts the pressure of the hydraulic oil supplied from a hydraulic oil tank (not shown). The hydraulic pump 64 is connected to the control valve 63 so that the hydraulic fluid boosted by the hydraulic pump 64 flows to the control valve 63.

An operation controller 67 is electrically connected to the control valve 63, the hydraulic pump 64, and the engine 65. In response to an instruction caused by the manipulation with a manipulation device 68 by the operator, the control valve 63 distributes the hydraulic oil (pressure oil) required for the traveling operation of the lower traveling body 51, the slewing operation of the upper slewing body 52, and the front operation by the front working machine 53 via the operation controller 67 to control their operations.

Specifically, the control signal from the operation controller 67 controls the switching direction of the control valve 63, its opening/closing timing, and the valve opening degree. The control signal from the operation controller 67 also controls the discharge amount of the hydraulic oil of the hydraulic pump 64. The control signal from the operation controller 67 to the engine 65 controls the driving start and stop of the engine 65 and the number of revolutions of the engine 65. In this way, the operation controller 67 controls the actuators of the work machine 5, including the boom cylinder 53*a*, the arm cylinder 53*b*, the bucket cylinder 53*c*, the traveling hydraulic motor 61, and the slewing hydraulic motor 62, about their supplying direction of the hydraulic oil, supplying start and stop, and the flow rate of the supplied hydraulic oil.

In the present embodiment, the manipulation device 68 includes a manipulation lever (not shown) and a gate lock lever 69 that the operator manipulates, and is a device manipulated by the operator. The operation controller 67 generates the above-stated control signals in accordance with the displacement with the manipulation device 68 to operate the work machine 5. The operation controller 67 may control the work machine 5 automatically, based on the input from an input device (not shown) as well as a control program, for example. In this embodiment, the operation controller 67 and an alarm controller 70A described later constitute a controller 7 of the work machine 5.

In the manipulation device 68, the gate lock lever 69 is installed inside the cabin 54 and is manipulated by the operator. The gate lock lever 69 of the present embodiment may be displaced up and down. When the operator manipulates the manipulation lever (not shown) with the gate lock lever 69 down (unlocked), the operator is allowed to perform traveling, slewing, and front operations of the work machine 5. When the gate lock lever 69 is up (locked), the operator is not allowed to perform traveling, slewing and front operations of the work machine 5 with the manipulation lever.

Figure 3:
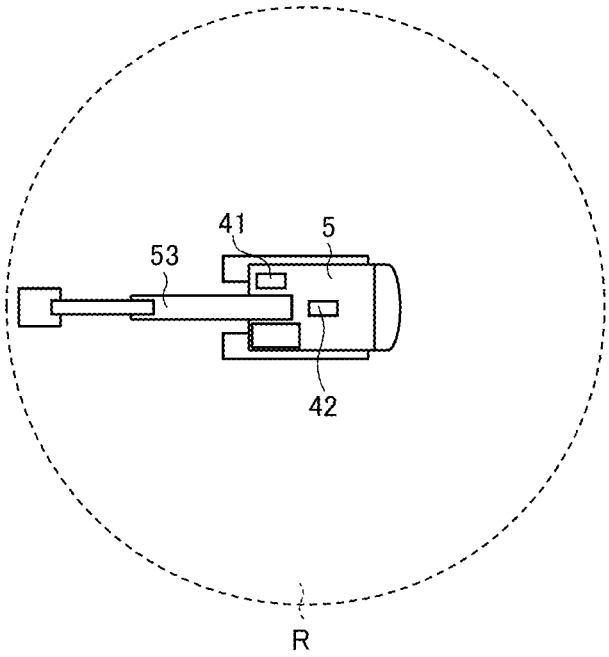
FIG. 3 describes the region to be detected by an identification information recognition device of the work machine shown in FIG. 1.

FIG. 3 describes the region to be detected by an identification information recognition device 41 of the work machine 5 shown in FIG. 1. In this embodiment, the work machine 5 further includes the identification information recognition device 41 and an alarm generator 42. The identification information recognition device 41 recognizes a person near the work machine 5 (specifically, a worker in a predetermined region R shown in FIG. 3), and is installed at the body of the work machine 5. In this embodiment, the work machine 5 includes a single identification information recognition device 41. The number of the identification information recognition device 41 is not limited and may be one or more, as long as it can recognize the presence of a worker in the predetermined region R of the work machine 5. As shown in FIG. 3, the predetermined region R in the present embodiment is within a circumference away from the work machine 5 by a certain distance. In the following description, a worker whose identification information is recognized may be referred to as a "person."

Note that the identification information recognition device 41 is not limited about its device configuration, as long as it recognizes the identification information of a person who entered the predetermined region R around the work machine 5. In the present embodiment, the identification information recognition device 41 may be an RFID reader provided in the work machine 5, and each worker in the work site may carry an RFID tag for specifying their individual identification information. When a worker approaches the work machine 5, the identification information recognition device 41 recognizes the identification information of the worker via a communication between the RFID tag and the RFID reader. In other examples, the identification information recognition device 41 may include an imaging device (camera) and an image processor to distinguish between persons by recognizing the face of a person including a worker who enters the predetermined region, or by recognizing the way a person walks in the predetermined region, and assign a number to each person for their identification information.

The identification information recognition device 41 is adapted to recognize persons who are close to the work machine 5 (for example, inside the slewing radius of the work machine 5 (hydraulic excavator)), and not to recognize persons who are far away from the work machine 5. For example, when an RFID reader and an RFID tag are used for the identification information recognition device 41, the identification information recognition device 41 is set so as to, when the strength of the radio wave of each RFID tag received by the RFID reader is equal to or less than a predetermined value, determine that there is a person outside the predetermined range and not to recognize the person. When an imaging device is used for the identification information recognition device 41, the identification information recognition device 41 is set so that a person who appears smaller than a predetermined range in the captured image is not recognized.

The alarm generator 42 generates an alarm to a person near the work machine 5, and one or more alarm generators 42 may be installed. In one example, the alarm generator 42 is a speaker that generates sound or voice toward the periphery of the work machine 5. In another example, the alarm generator 42 may be installed inside the cabin 54 to generate an alarm to the operator. In addition to the alarm generator 42, the operator or the workers may carry an alarm device that generates a similar alarm with sound or vibration.

Figure 4:
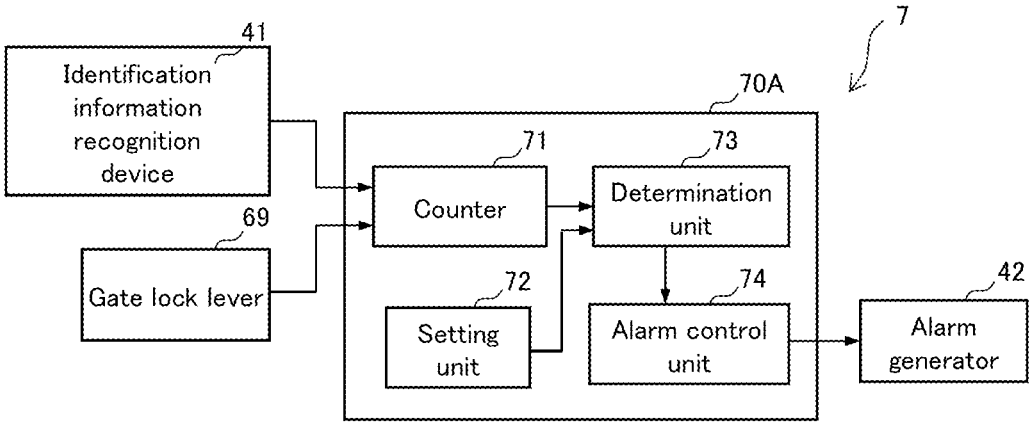
FIG. 4 is a block diagram of a controller of the work machine of FIG. 1.

FIG. 4 is a block diagram of an alarm controller 70A that constitutes the work machine 5 according to the first embodiment, and the alarm controller 70A controls the alarm generator 42. As shown in FIG. 4, the controller 7 in this embodiment further includes the alarm controller 70A that performs process based on the identification information recognized by the identification information recognition device 41.

In the present embodiment and the following embodiments, when a person enters the predetermined region R under the condition that the work machine 5 is ready for operation, the alarm controller 70A counts the number of times the person enters the predetermined region R as the number of approaches for each person distinguished with the identification information. The alarm controller 70A then controls the work machine 5 based on the counted number of approaches in accordance with the identification information of the person who is in the predetermined region R.

In the present embodiment and the second embodiment shown below, controlling the work machine 5 includes controlling an alarm by the alarm generator 42. In the third through sixth embodiments described later, controlling the work machine 5 includes limiting (changing) the operating speed of the work machine 5. Specifically, in the third and fourth embodiments, controlling the work machine 5 includes reducing the operating speed of the work machine 5. In the fifth and sixth embodiments, controlling the work machine 5 includes stopping the operation of the work machine 5. In the seventh embodiment, controlling the work machine 5 includes selecting the way of controlling an alarm of the alarm generator 42 and the way of limiting the operating speed of the work machine 5. Note that, in this description, limiting the operating speed of the work machine 5 includes stopping the operation of the work machine 5 (i.e., setting the operating speed at 0).

To control the work machine 5, the alarm controller 70A in this embodiment controls the alarm of the alarm generator 42 based on the counted number of approaches. More specifically, to control the work machine 5, the alarm controller 70A controls the alarm generator 42 so that the alarm becomes larger as the number of approaches increases. In the following embodiments, the alarm becomes larger as the number of approaches increases. In another example, the alarm may be controlled so that the range of the alarm sound becomes higher or the content of the alarm is changed as the number of approaches increases.

Specifically, the alarm controller 70A includes a counter 71, a setting unit 72, a determination unit 73, and an alarm control unit 74. In the present embodiment, when a person enters the predetermined region R as stated above under the condition that the work machine 5 is ready for operation, the counter 71 counts the number of times the person enters the predetermined region R as the number of approaches for each person distinguished with the identification information.

In the present embodiment, the condition that the work machine 5 is ready for operation means that the gate lock lever 69 is down. When this condition is satisfied, the work machine 5 may operate. Therefore, when a person approaches the work machine 5 (i.e., entered the predetermined region R) after this condition is satisfied, the counter 71 counts the number of times (hereinafter referred to as the "number of approaches") the person approached the work machine 5 in the past for each person distinguished with the identification information, and stores this number of approaches.

Specifically, while setting the duration from the entrance of a person in the predetermined region R to the leaving the predetermined region R once, the counter 71 reads the stored number of approaches in the past and adds one to this number of approaches, and updates the value obtained by adding one as a new number of approaches for storing. At the timing when the number of approaches is updated, the counter 71 outputs the updated number of approaches to the determination unit 73.

In this embodiment, the counter 71 outputs, for each of the persons who are near the work machine 5 (entered the predetermined region R), their identification information and the counted number of approaches in accordance with the identification information to the determination unit 73. Note that, when the gate lock lever 69 is up or there is no person nearby, the counter 71 outputs "None" for the identification information and "0" for the number of approaches to the determination unit 73.

Figure 5:
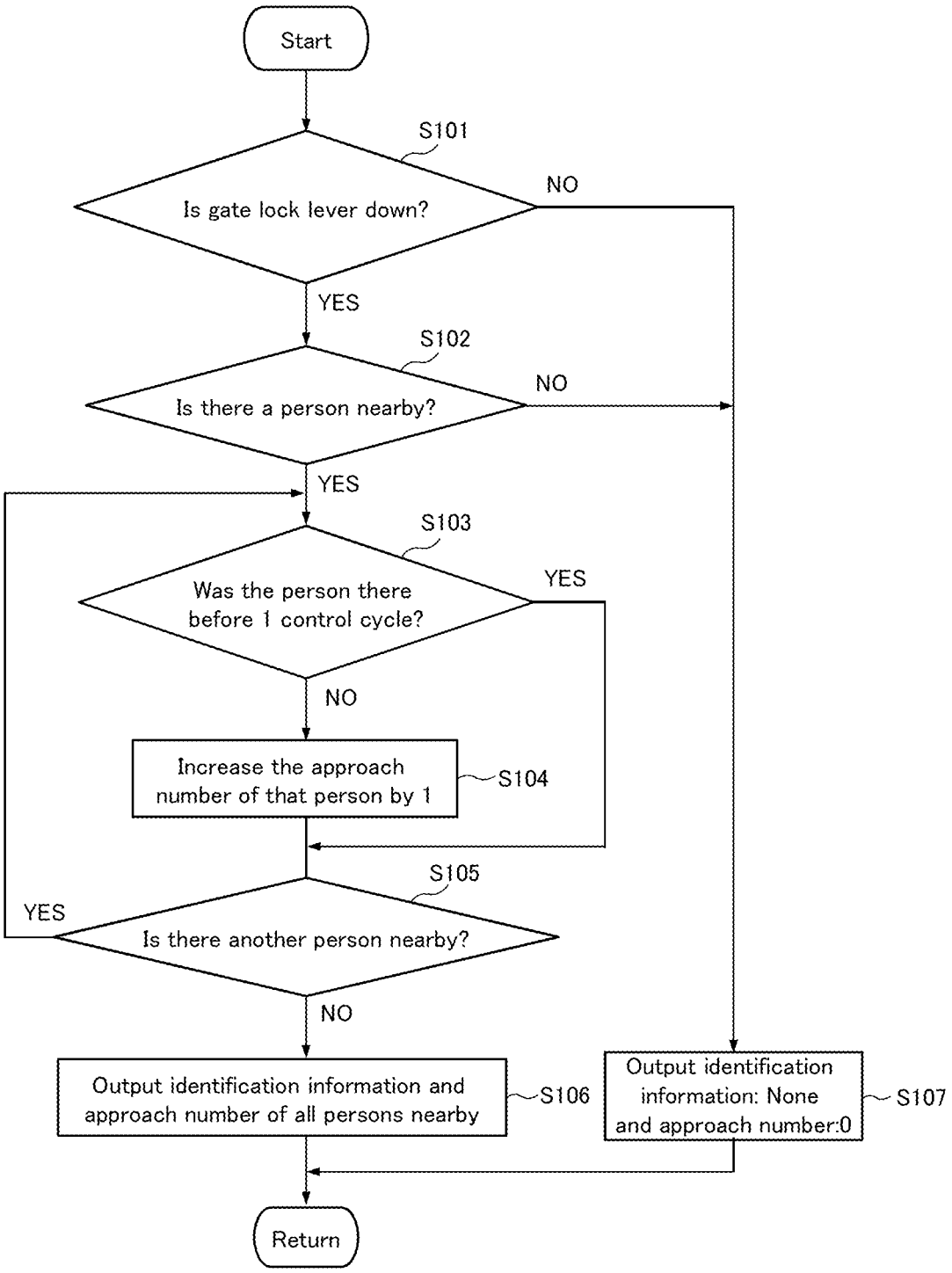
FIG. 5 is a flowchart of the process executed by a counter shown in FIG. 4.

FIG. 5 is a flowchart of the process by the counter 71. In step S101, the process determines the state of the gate lock lever 69. In step S101, when the gate lock lever 69 is down, the process determines that the work machine 5 is ready for operation, and the process proceeds to step S102. When the gate lock lever 69 is up, the process determines that the work machine 5 is not ready for operation, and the process proceeds to step S107.

In step S102, the process determines whether there is a person near the work machine 5 (i.e., whether there is a person in the predetermined region R). This determination is performed by checking whether the identification information recognition device 41 outputs identification information or not. When the identification information recognition device 41 outputs identification information, the process determines that there is a person near the work machine 5, and the process proceeds to step S103. When the identification information recognition device 41 does not output identification information, the process determines that there is no person nearby and the process proceeds to step S107.

In step S103, the process determines whether the person recognized by the identification information recognition device 41 was near the work machine 5 before one control cycle of the alarm controller 70A (i.e., whether the recognized person has been continuously in the predetermined region R or not). The one control cycle is the calculation cycle of the controller 7, which is a cycle on the order of ms (milliseconds). The same person may continuously stay near the work machine 5, and this step S103 prevents the number of approaches from continuously increasing due to that person.

Specifically, it is determined in step S103 that the recognized person was not nearby before one control cycle, the process proceeds to step S104. In step S104, the number of approaches corresponding to the identification information of that person is increased by 1, and the process proceeds to step S105. It is determined in step S103 that the recognized person was nearby also before one control cycle, the process skips step S104 and proceeds to step S105.

In step S105, the process checks whether the identification information recognition device 41 outputs other information to determine whether another person is near the work machine. If the determination result shows the presence of another person, the process returns to step S103. If not, the process proceeds to step S106. In other words, the process performs from step S103 to step S104 for all the persons in the predetermined region R recognized by the identification information recognition device 41. This enables counting of the number of approaches, that is, the number of times each person, distinguished with identification information, entered the predetermined region R. In step S106, the process outputs identification information on all the persons near the work machine 5 associated with their numbers of approaches to the determination unit 73. In S107, the process outputs "None" as the identification information and "0" as the number of approaches. Note that the counter 71 repeats a series of these steps, and so counts the number of approaches in real time.

Figures 6, 7, 8:
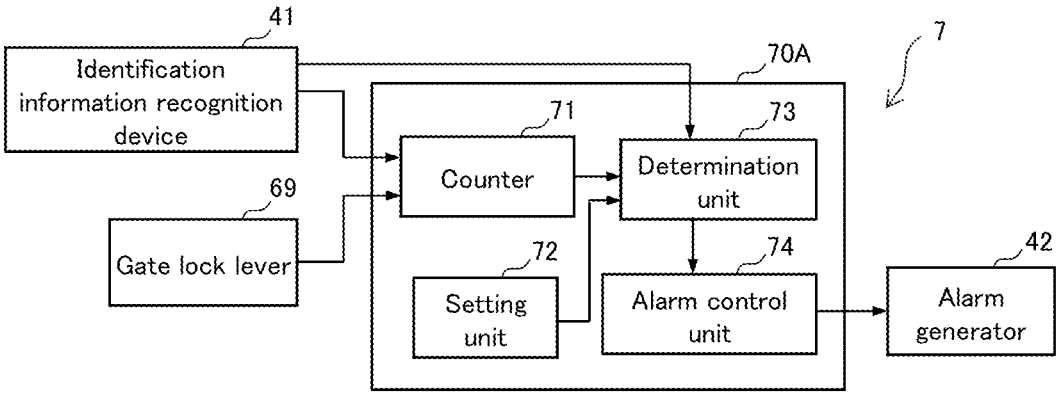
FIG. 6 shows the magnitude of an alarm versus the number of approaches, set by the setting unit shown in FIG. 4.
FIG. 7 shows a modified example of the setting unit of FIG. 6.
FIG. 8 is a block diagram of a controller of the work machine according to a second embodiment.

FIG. 6 shows the magnitude of an alarm versus the number of approaches, set by the setting unit 72 shown in FIG. 4. As shown in the table of FIG. 6, the setting unit 72 sets the relationship between the number of approaches counted by the counter 71 and the magnitude of an alarm generated by the alarm generator 42.

Specifically, the setting unit 72 does not make the alarm generator 42 generate an alarm when the number of approaches is zero, and sets a larger alarm as the number of approaches increases. In one example, the setting unit 72 of the present embodiment sets the magnitude of alarm: a small alarm for small numbers of approaches (e.g., the number of approaches is 1 to 3); a medium level of alarm for the numbers of approaches in a medium level (e.g., the number of approaches is 4 to 8); and a large alarm for large numbers of approaches (e.g., the number of approaches is 9 or more).

In this embodiment, the setting unit 72 sets the range of the number of approaches. This sets the magnitude of alarm so that the alarm becomes larger in a stepwise manner with an increase in the number of approaches. In another embodiment, the magnitude of alarm may be set so that it gradually becomes larger with an increase in the number of approaches.

The determination unit 73 reads the relationship between the number of approaches and the magnitude of the alarm set by the setting unit 72 based on the number of approaches counted by the counter 71, and determines the way of controlling the work machine 5. To determine the alarm magnitude, the determination unit 73 in the present embodiment reads the alarm magnitude set by the setting unit 72 based on the highest number of approaches (the maximum number of approaches) among the number of approaches counted in accordance with a plurality of pieces of identification information from the counter 71. For example, when the maximum value of the number of approaches is 0, this means that there is no person near the work machine 5. Then, the determination unit 73 determines that no alarm is generated based on the relationship shown in FIG. 6. For other cases, the determination unit 73 determines the magnitude of alarm as follows, that is, for a maximum value of the number of approaches in a small range, the determination unit 73 sets a small alarm, for a maximum value of the number of approaches in a medium range, the determination unit 73 sets a large alarm, and for a maximum value of the number of approaches in a large range, the determination unit 73 sets a much larger alarm.

The alarm control unit 74 generates a control signal according to the magnitude of the alarm determined by the determination unit 73, and outputs the control signal to the alarm generator 42. This allows the alarm generator 42 to generate no alarm when the maximum number of approaches is zero (i.e., when there is no person nearby), and generate a larger alarm as the maximum number of approaches increases. In this way, if the persons near the work machine 5 include a person (careless person) who has approached the work machine frequently, a larger alarm will be generated for attracting their attention strongly. In contrast, when all the persons nearby have approached the work machine a small number of times, the magnitude of the alarm is reduced. As such, the present embodiment eliminates the inconvenience from the operator of the work machine 5 as much as possible while deterring a contact between the work machine 5 and other persons (workers), and suppresses a decrease in productivity of the work machine 5.

FIG. 7 shows a modified example of the setting unit 72 of FIG. 6. As shown in FIG. 7, the setting unit 72 sets whether or not to generate an alarm so that an alarm is generated when the number of approaches counted by the counter 71 is a predetermined number or more. Specifically, in one example, the setting unit 72 of the present embodiment sets the alarm: no alarm is generated for small numbers of approaches (e.g., the number of approaches is less than 4); and alarm is generated for numbers of approaches in a medium level and for large numbers of approaches (e.g., the number of approaches is 4 or more). With this configuration, the determination unit 73 determines to generate an alarm when the maximum number of approaches output by the counter 71 is a predetermined number or more, and the alarm control unit 74 generates a control signal according to the determination by the determination unit 73 about whether or not to generate an alarm, and outputs the control signal to the alarm generator 42.

This modified example also allows the alarm generator 42 not to generate an alarm if there is no person (careless person) who has the counted number of approaches more than the predetermined value, and if not, the alarm generator 42 to generate an alarm.

Second Embodiment

Referring next to FIGS. 8 to 11, the following describes a work machine 5 that is a second embodiment of the present invention. The work machine 5 of this embodiment is different from the first embodiment in that the identification information recognition device 41 measures the approach distance, and the alarm controller 70A controls the alarm of the alarm generator 42 based on the number of approaches and the approach distance. The other configurations are the same as in the first embodiment, and their detailed descriptions are omitted.

FIG. 8 is a block diagram of an alarm controller 70A of a work machine according to the second embodiment. In the present embodiment, the work machine 5 includes a distance measurement device that measures the approach distance of a person from the work machine 5 when they enter the region and approach the work machine 5. In the present embodiment, the identification information recognition device 41 measures the approach distance, meaning that the identification information recognition device 41 doubles as the distance measurement device. The approach distance is the distance from the work machine 5 (specifically, the identification information recognition device 41) to the person who is in the region.

Specifically, the identification information recognition device 41 recognizes the identification information of a person who is near the work machine 5, and also estimates the approach distance between the person whose identification information is recognized and the work machine 5. The identification information recognition device 41 associates the estimated approach distance with the identification information of the person and outputs it to the determination unit 73. In one example, the identification information recognition device 41 may include a RFID reader. In this case, the RFID reader estimates the approach distance based on the strength of the radio waves generated by the RFID tag carried by a worker. In another example, the identification information recognition device 41 may include a stereo camera and an image processor. In this case, the identification information recognition device 41 estimates the approach distance from the parallax of the stereo camera.

Figure 9:
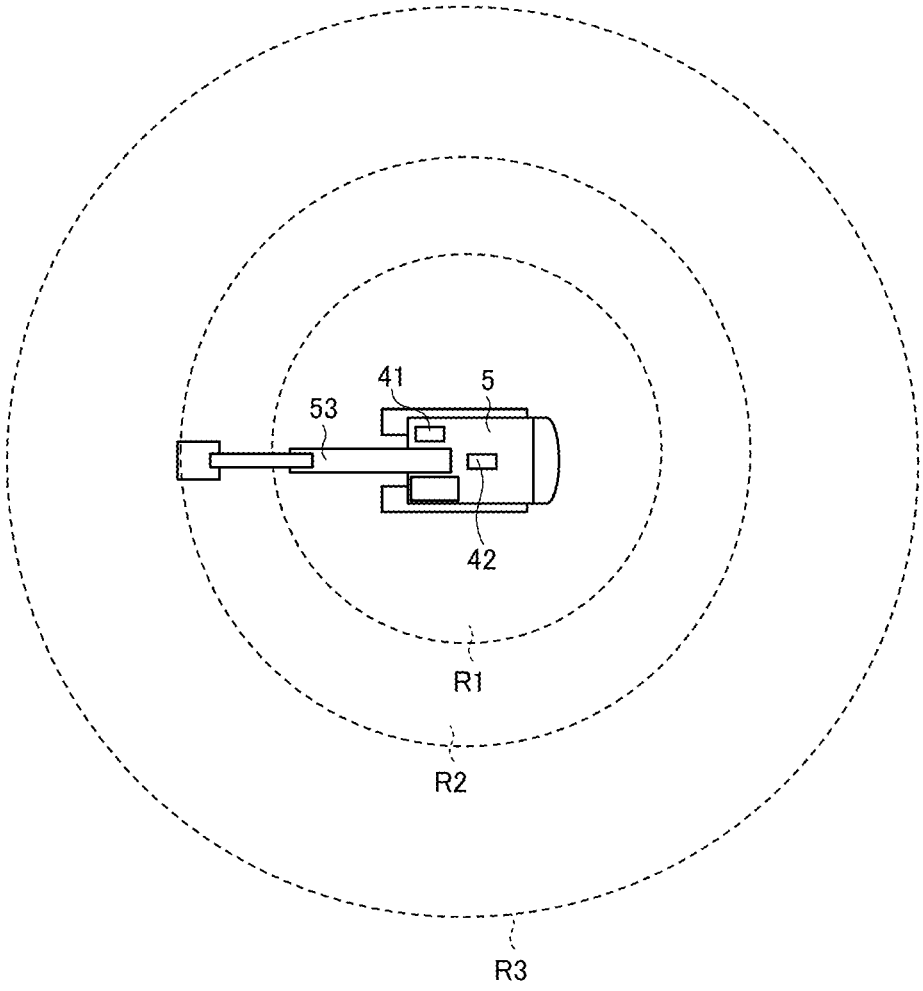
FIG. 9 describes the regions set by the setting unit according to the second embodiment.

To control the work machine 5, the alarm controller 70A in this embodiment controls the alarm of the alarm generator 42 based on the number of approaches of each person who entered predetermined regions R1 to R3 and their approach distances. Specifically, to control the work machine 5, the alarm controller 70A of the present embodiment controls the alarm generator 42 so that the alarm becomes larger as the number of approaches increases or the approach distance shortens. Referring to FIGS. 9 and 10, the details are described below.

FIG. 9 describes the regions set by the setting unit 72 according to the second embodiment, and FIG. 10 shows the relationship between the number of approaches and the approach distance, and the magnitude of alarm set by the setting unit 72 shown in FIG. 9. Specifically, as shown in the table of FIG. 10, the setting unit 72 of the present embodiment sets the magnitude of alarm generated by the alarm generator 42 based on the number of approaches and the approach distance.

In this embodiment, when the number of approaches is zero, the setting unit 72 sets so that no alarm is generated by the alarm generator 42. Then, the setting unit 72 sets so that the alarm becomes larger as the number of approaches increases or the approach distance shortens.

When a person enters a circular region R1 shown in FIG. 9 (e.g., the approach distance is within 1.5 m), the present embodiment determines that the approach distance is "very short". When a person enters a circular region R2 adjacent to region R1 (e.g., the approach distance exceeds 1.5 m and is within 3 m), the present embodiment determines that the approach distance is "short". When a person enters a circular region R3 adjacent to region R2 relative to the swiveling radius of the hydraulic excavator, for example (e.g., the approach distance exceeds 3 m and is within 5 m), the present embodiment determines that the approach distance is "normal".

In accordance with these ranges of the approach distance and the ranges of the number of approaches described above, the setting unit 72 sets the magnitude of the alarm generated by the alarm generator 42, as shown in FIG. 10. In the present embodiment, the counter 71 counts the number of approaches of a person who enters the regions in association with the identification information of the person.

The determination unit 73 determines whether a person is near the work machine 5 based on the approach distance estimated by the identification information recognition device 41. Specifically, at the timing of executing steps S102 and S105 in FIG. 5 by the counter 71, the determination unit 73 determines in which range of FIG. 10 the approach distance estimated by the identification information recognition device 41 is. Then, the determination unit 73 determines the magnitude of the alarm based on the number of approaches and the approach distance for each person who entered the regions R1 to R3 in accordance with the table of FIG. 10.

Furthermore, when a plurality of persons entered the predetermined regions R1 to R3, the determination unit 73 of the present embodiment determines the magnitude of the alarm for each of the plurality of persons based on the number of approaches and the approach distance for the person who is in the regions. Specifically, at the timing of executing step S102 and step S105 in FIG. 5 by the counter 71, the determination unit 73 determines the magnitude of the alarm for all the persons who entered the regions R1 to R3. Based on the determination result, the determination unit 73 then selects the alarm with the largest magnitude among the plurality of determined alarms, and determines that the alarm generator 42 generates the alarm with the selected magnitude. For example, a first person with a small number of approaches and a short approach distance is determined to correspond to a small alarm, and a second person with a large number of approaches and a normal approach distance is determined to correspond to a medium alarm. In this case, the determination unit 73 selects the second person and determines that the magnitude of the alarm to be generated by the alarm generator 42 is medium.

The alarm control unit 74 generates a control signal according to the magnitude of the alarm determined by the determination unit 73, and outputs the control signal to the alarm generator 42. In this way, this embodiment changes the magnitude of the alarm of the alarm generator 42 while further adding the approach distance to the number of approaches, thus avoiding a contact between the work machine 5 and a person more reliably. Further, if a plurality of persons enter the predetermined regions R1 to R3, the alarm generator 42 may generate an alarm with the magnitude corresponding to the person who is most likely to come into contact with the work machine 5.

FIG. 11 shows a modified example of the setting unit 72 of FIG. 8. As shown in FIG. 11, this modified example sets whether or not to generate an alarm based on the number of approaches and the approach distance. Specifically, the setting unit 72 sets alarm "No" for a person who has a small number of approaches and a normal or short approach distance and for a person who has a medium number of approaches and a normal approach distance, because they are careful persons. In contrast, the setting unit 72 sets alarm "Yes" for a person who entered the predetermined regions R1 to R3 the other numbers of times because they are careless persons.

In this way, when a plurality of persons entered the predetermined regions R1 to R3, the determination unit 73 determines whether or not to generate an alarm for each of the plurality of persons, based on the number of approaches and the approach distance for the person. Then, when the determination unit 73 determines that an alarm is to be generated even for one of the plurality of persons, the determination unit 73 determines to generate an alarm, and the alarm control unit 74 generates a control signal according to the determination by the determination unit 73 about whether or not to generate an alarm, and outputs the control signal to the alarm generator 42.

This modified example also controls whether or not to generate an alarm by the alarm generator 42 while further adding the approach distance to the number of approaches, thus avoiding a contact between the work machine 5 and a person more reliably. Further, if a plurality of persons entered the predetermined regions R1 to R3, the alarm generator 42 generates an alarm corresponding to the person who is most likely to come into contact with the work machine 5. In both the first and second embodiments, when the identification information recognition device 41 does not recognize any person in the predetermined region(s), the alarm controller 70A cancels the alarm by the alarm generator 42.

Third Embodiment

Figure 12:
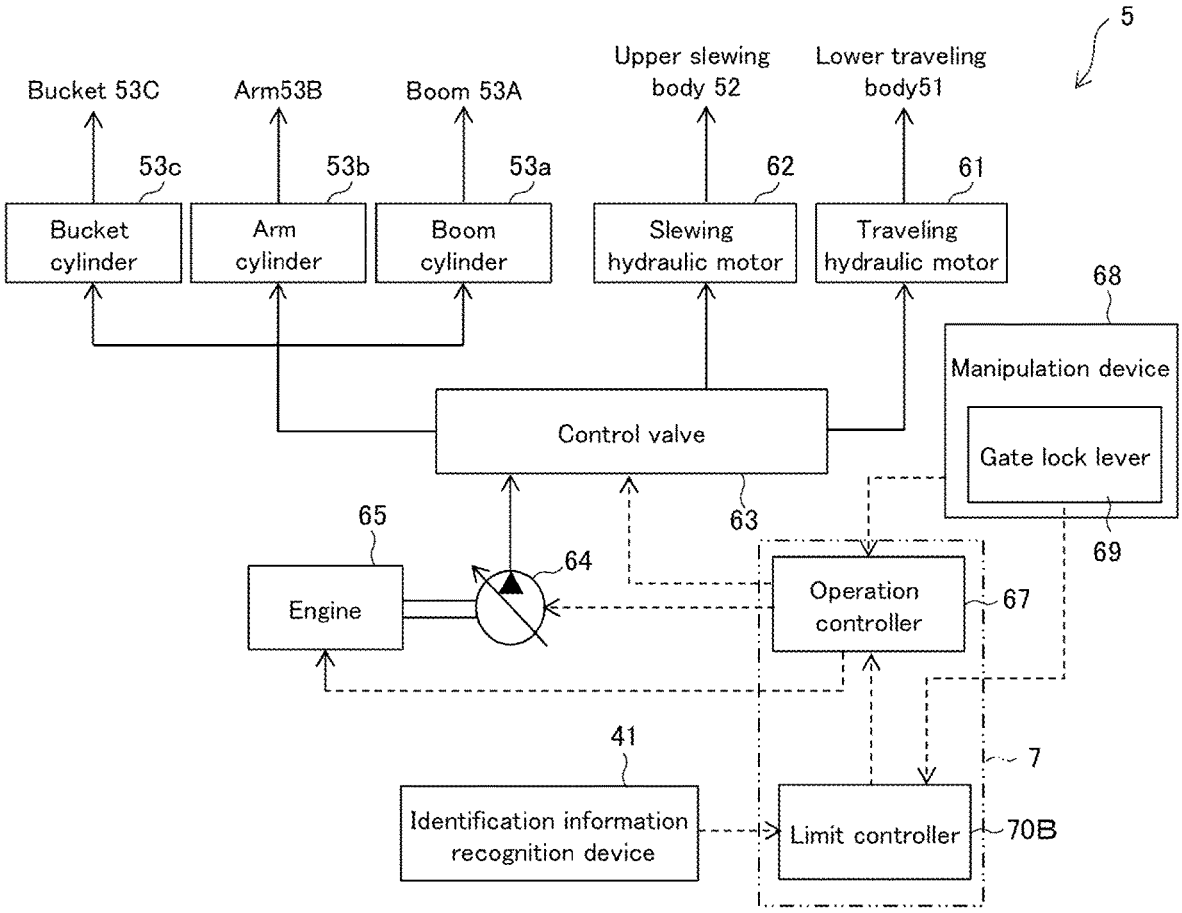
FIG. 12 is a block diagram of a work machine according to a third embodiment.
Figure 13:
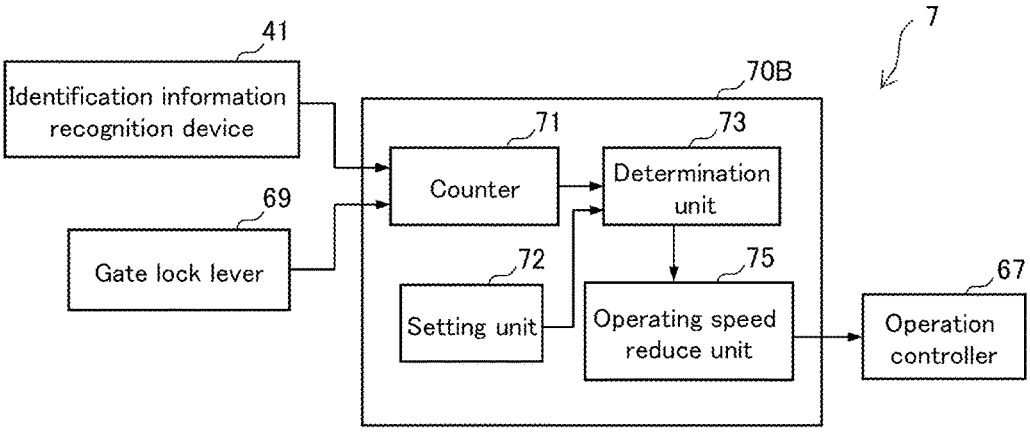
FIG. 13 is a block diagram of a controller of the work machine of FIG. 12.

Referring next to FIGS. 12 to 14, the following describes a work machine 5 that is a third embodiment of the present invention. The work machine 5 of this embodiment is different from the first embodiment in that, instead of the alarm generator 42 and the alarm controller 70A, it includes a limit controller 70B that limits (changes) the operating speed of the work machine 5. The other configurations are the same as in the first embodiment, and their detailed descriptions are omitted. FIG. 12 is a block diagram of the work machine according to the third embodiment. FIG. 13 is a block diagram of the controller 7 of the work machine 5 in FIG. 12. FIG. 14 shows the relationship between the reduction in operating speed of the work machine 5 and the number of approaches, set by the setting unit shown in FIG. 13.

The present embodiment is the same as the first embodiment in that the limit controller 70B controls the work machine 5: as shown in FIG. 14, the limit controller 70B limits the operating speed of the work machine 5 via the operation controller 67 based on the number of approaches. The limit controller 70B of the present embodiment slows down the operating speed of the work machine 5 via the operation controller 67 as the number of approaches increases.

Specifically, the limit controller 70B issues an instruction to the operation controller (specifically, the engine controller) 67 to reduce the number of revolutions of the engine 65, thus reducing the operating speed of the work machine 5. In addition, the limit controller 70B may issue an instruction to the operation controller 67 (specifically the valve controller) to reduce the flow rate of hydraulic oil to the control valve 63 that controls traveling, slewing and front operations, thus reducing the operating speed of the work machine 5.

As shown in FIG. 13, specifically, the limit controller 70B includes a counter 71 having the same function as in the alarm controller 70A according to the first embodiment. In the present embodiment, the limit controller 70B further includes a setting unit 72, a determination unit 73, and an operating speed reduce unit 75.

As shown in FIG. 14, the setting unit 72 of the present embodiment sets the relationship between the number of approaches counted by the counter 71 and the magnitude of the reduction in the operating speed of the work machine 5. Specifically, the setting unit 72 sets no reduction of the operating speed of the work machine 5 when the number of approaches is 0, and increases the reduction in operating speed to slow down the operating speed of the work machine 5 as the number of approaches increases. Specifically, in one example, the present embodiment sets a small reduction in operating speed of the work machine 5 in the range of small numbers of approaches, sets a medium level of reduction of the operating speed in the range of a medium level of the numbers of approaches, and sets a large reduction in the range of large numbers of approaches. This reduction in the operating speed of the work machine 5 matches the operating speed of the work machine 5 that operates in response to predetermined manipulations with the manipulation device 68 of the work machine 5. The reduction in operating speed of the work machine 5 may be set so that the operating speed is constant for each set range of numbers of approaches (small (a few), medium, and large (many)), or the reduction may be set so that the operating speed is the value obtained by multiplying the speed controlled in accordance with the manipulation with the manipulation device 68 of the work machine 5 by a predetermined ratio (a ratio of 1 or less).

In this embodiment, as shown in FIG. 14, the setting unit 72 sets the range of the number of approaches. This sets the reduction in operating speed so that the operating speed of the work machine 5 slows down in a stepwise manner with an increase in the number of approaches. In another embodiment, the setting unit 72 may set the reduction in operating speed so that it gradually increases with an increase in the number of approaches.

The determination unit 73 reads the relationship between the number of approaches and the magnitude of the reduction set by the setting unit 72 based on the number of approaches counted by the counter 71, and determines the way of controlling the work machine 5. When a plurality of persons entered the predetermined region R, the determination unit 73 of the present embodiment determines the reduction in operating speed based on the largest number of approaches (maximum value of the number of approaches) among the number of approaches for the plurality of persons.

For example, when the maximum value of the number of approaches is 0, this means that there is no person near the work machine 5. Then, the determination unit 73 determines that this is the case of no reduction not to limit the operating speed of the work machine 5 based on the relationship shown in FIG. 14. For other cases, the determination unit 73 determines the magnitude of reduction as follows, that is, for a smaller maximum value of the number of approaches, the determination unit 73 sets a small reduction, for a maximum value of the number of approaches in a medium range, the determination unit 73 sets a medium level of reduction, and for a larger maximum value of the number of approaches, the determination unit 73 sets a larger reduction.

The operating speed reduce unit 75 generates a control signal according to the magnitude of the reduction determined by the determination unit 73, and outputs the control signal to the operation controller 67. This allows the operation controller 67 to control the operating speed of the work machine 5 so as not to limit the operating speed of the work machine 5 when the maximum number of approaches is zero (i.e., when there is no person nearby), and to slow down the operating speed of the work machine 5 as the maximum number of approaches increases. To slow down the operating speed of the work machine 5, the operating speed reduce unit 75 controls to reduce the number of revolutions of the engine 65 or reduce the flow rate of hydraulic fluid to the control valve 63 or each actuator via the operation controller 67 as described above.

In this way, if the persons near the work machine 5 include a person (careless person) who has approached the work machine frequently, this embodiment slows down the operating speed of the work machine 5 to avoid a contact of the person with the work machine 5. When all the persons have a small number of approaches, this embodiment sets a small reduction in operating speed of the work machine 5, thus eliminating inconvenience from the operator of the work machine 5 and suppressing the loss of productivity of the work machine 5.

In a modified example of the present embodiment, the limit controller 70B may set so as to slow down the operating speed when the number of approaches output by the counter 71 exceeds a predetermined value. Further, after the number of approaches output by the counter 71 reaches the predetermined number, the limit controller 70B may slow down the operating speed of the work machine 5 as the number of approaches increases.

Fourth Embodiment

Referring next to FIGS. 15 and 16, the following describes a work machine 5 that is a fourth embodiment of the present invention. The work machine 5 of this embodiment is different from the third embodiment in that the identification information recognition device 41 measures the approach distance, and the limit controller 70B limits (changes) the operating speed of the work machine 5 based on the number of approaches and the approach distance. The other configurations are the same as in the third embodiment, and their detailed descriptions are omitted.

FIG. 15 is a block diagram of the controller 7 of the work machine 5 according to the fourth embodiment. In the present embodiment, the work machine 5 includes a distance measurement device that measures the approach distance of a person from the work machine 5 when they enter the region and approach the work machine 5. In the present embodiment, the identification information recognition device 41 measures the approach distance, meaning that the identification information recognition device 41 doubles as the distance measurement device, and the present embodiment is the same in this respect as the identification information recognition device 41 of the work machine 5 in the second embodiment. Note here that the approach distance is the distance from the work machine 5 (specifically, the identification information recognition device 41) to the person who is in the region.

To control the work machine 5, the limit controller 70B in this embodiment controls the operating speed of the work machine 5 based on the number of approaches of each person who entered predetermined regions R1 to R3 and their approach distances. More specifically, the limit controller 70B slows down the operating speed of the work machine 5 as the number of approaches increases or the approach distance shortens. Referring to FIG. 16, the details are described below.

FIG. 16 shows the reduction in operating speed of the work machine 5 versus the number of approaches and the approach distance, set by the setting unit 72 shown in FIG. 15. As shown in the table of FIG. 16, the setting unit 72 of the present embodiment sets the reduction in operating speed of the work machine 5 based on the number of approaches and the approach distance.

Specifically, when the number of approaches is zero, the setting unit 72 sets so as not to limit the operating speed of the work machine 5. Then, the setting unit 72 sets so that the reduction in operating speed of the work machine 5 increases as the number of approaches increases or the approach distance shortens. As shown in FIG. 16, the setting unit 72 of the present embodiment sets, together with the range of approach distances and the range of number of approaches described in the second embodiment, the reduction in operating speed of the work machine 5. In the present embodiment, the counter 71 counts the number of approaches of a person who enters the regions in association with the identification information of the person.

Similarly to the second embodiment, the determination unit 73 determines in which range of FIG. 16 the approach distance estimated by the identification information recognition device 41 is. Then, the determination unit 73 determines the reduction in operating speed based on the number of approaches and the approach distance for each person who entered the regions R1 to R3 in accordance with the table of FIG. 16.

Furthermore, when a plurality of persons entered the predetermined regions R1 to R3, the determination unit 73 of the present embodiment determines the reduction in operating speed of the work machine 5 for each of the plurality of persons based on the number of approaches and the approach distance for the person who is in the region. More specifically, the determination unit 73 determines the reduction in operating speed for each person who entered the regions R1 to R3 in accordance with FIG. 16. Then, based on the determination result, the determination unit 73 selects the largest reduction among the plurality of determined reductions. For example, a first person with a small number of approaches and a short approach distance is determined to correspond to a small reduction, and a second person with a large number of approaches and a normal approach distance is determined to correspond to a medium reduction. In this case, the determination unit 73 selects the second person and determines that the reduction in operating speed of the work machine 5 is medium.

The operating speed reduce unit 75 generates a control signal according to the largest reduction determined by the determination unit 73, and outputs the control signal to the operation controller 67. This controls the work machine 5 to operate at the operating speed of the largest reduction. In this way, when a plurality of persons entered the predetermined region R, the determination unit 73 determines the operating speed for each of the plurality of persons based on the number of approaches and the approach distance for the person. Then the work machine 5 is controlled at the slowest operating speed among the determined operating speeds of the plurality of persons.

As described above, the present embodiment controls so that the reduction in operating speed increases (the operating speed slows down) as the number of approaches increases or the approach distance shortens. Further, if the persons near the work machine 5 include a person who has approached the work machine frequently, this embodiment slows down the operating speed of the work machine 5 to allow the operator to easily stop the work machine 5 before the person comes in contact with the work machine 5. Further, if a plurality of persons entered the predetermined regions R1 to R3, the present embodiment limits the operating speed of the work machine 5 corresponding to the person who is most likely to come into contact with the work machine 5.

In a modified example of the present embodiment, the limit controller 70B may set whether or not to limit the operating speed of the work machine 5 based on the increased number of approaches and the reduced approach distance. For example, the setting unit 72 sets not to limit the operating speed for a person who has a small number of approaches and a normal or short approach distance and for a person who has a medium number of approaches and a normal approach distance, because they are careful persons. In contrast, the setting unit 72 sets to limit the operating speed for a person who entered the predetermined regions R1 to R3 the other numbers of times because they are careless persons. In both the third and fourth embodiments, when the identification information recognition device 41 does not recognize any person in the predetermined region(s), the limit controller 70*b* cancels the reduction in operating speed to return the speed to a desired operating speed with the manipulation device 68.

Fifth Embodiment

Referring next to FIGS. 17 and 18, the following describes a work machine 5 that is a fifth embodiment of the present invention. The work machine 5 of this embodiment is different from the third embodiment in that the limit controller 70B includes an operation stop unit 76 instead of the operating speed reduce unit 75. The other configurations are the same as in the third embodiment, and their detailed descriptions are omitted.

The present embodiment is the same as the third embodiment in that the limit controller 70B limits the operation (changes the operating speed) of the work machine 5: as shown in FIG. 18, to control the work machine 5, the limit controller 70B forcibly stops the operation of the work machine 5 when the number of approaches is a predetermined number or more.

Specifically, the limit controller 70B issues an instruction to the operation controller (specifically, the engine controller) 67 to stop the engine 65, thus stopping the operation of the work machine 5. In addition, the limit controller 70B may issue an instruction to the operation controller 67 (specifically the valve controller) to stop the flow of hydraulic oil to the control valve 63 that controls traveling, slewing and front operations, thus stopping the operation of the work machine 5.

Specifically, as shown in FIG. 17, the limit controller 70B includes a counter 71 having the same function as in the alarm controller 70A according to the first embodiment. In the present embodiment, the limit controller 70B further includes a setting unit 72, a determination unit 73, and an operation stop unit 76.

As shown in FIG. 18, the setting unit 72 of the present embodiment sets the relationship between the number of approaches counted by the counter 71 and the operation stopping of the work machine 5. Specifically, the setting unit 72 sets so as to stop the operation of the work machine 5 when the number of approaches output by the counter 71 is a predetermined number or more. In one example, the setting unit 72 of the present embodiment sets not to stop the operation of the work machine 5 in the range of the numbers of approaches that are 0 or small numbers, and sets to stop the operation of the work machine 5 in the range of medium and large numbers of approaches.

The determination unit 73 reads the relationship between the number of approaches and whether or not to stop the operation set by the setting unit 72 based on the number of approaches counted by the counter 71, and determines the way of controlling the work machine 5. When a plurality of persons entered the predetermined region R, the determination unit 73 of the present embodiment determines whether or not to stop the operation based on the largest number of approaches (maximum value of the number of approaches) among the number of approaches for the plurality of persons.

For example, when the maximum value of the number of approaches is 0, this means that there is no person near the work machine 5. Then, the determination unit 73 determines not to stop the work machine 5 based on the relationship shown in FIG. 18. Similarly, when the maximum value of the number of approaches is small, the determination unit 73 determines not to stop the work machine 5. In contrast, when the maximum value of the number of approaches is in the range of medium or large, the determination unit 73 determines to stop the work machine 5.

The operation stop unit 76 generates a control signal according to the determination by the determination unit 73 whether or not to stop the work machine 5, and outputs the control signal to the operation controller 67. This allows the operation controller 67 not to stop the work machine 5 when the maximum number of approaches is zero (i.e., when there is no person nearby) or when the maximum number of approaches is small, and to stop the operation of the work machine 5 when the maximum number of approaches is in the range of medium or large.

In this way, if the persons near the work machine 5 include a person (careless person) who has approached the work machine frequently, this embodiment stops the operation of the work machine 5 to avoid a contact of the person with the work machine 5. When all the persons have a small number of approaches, this embodiment does not stop the operation of the work machine 5, thus eliminating inconvenience from the operator of the work machine 5 and suppressing the loss of productivity of the work machine 5.

Sixth Embodiment

Referring next to FIGS. 19 and 20, the following describes a work machine 5 that is a sixth embodiment of the present invention. The work machine 5 of this embodiment is different from the fifth embodiment in that the identification information recognition device 41 measures the approach distance, and the limit controller 70B stops the operation of the work machine 5 based on the number of approaches and the approach distance. The other configurations are the same as in the fifth embodiment, and their detailed descriptions are omitted.

FIG. 19 is a block diagram of the controller 7 of the work machine 5 according to the sixth embodiment. In the present embodiment, the work machine 5 includes a distance measurement device that measures the approach distance of a person from the work machine 5 when they enter the region and approach the work machine 5. In the present embodiment, the identification information recognition device 41 measures the approach distance, meaning that the identification information recognition device 41 doubles as the distance measurement device, and the present embodiment is the same in this respect as the identification information recognition device 41 of the work machine 5 described in the second and fourth embodiments.

To control the work machine, the limit controller 70B in this embodiment stops the operation of the work machine 5 based on the number of approaches of each person who entered predetermined regions R1 to R3 and their approach distances. FIG. 20 shows setting by the setting unit 72 shown in FIG. 19 about the number of approaches and the approach distance versus whether or not to stop the operation of the work machine 5. Specifically, as shown in the table of FIG. 20, the setting unit 72 sets whether or not to stop the operation of the work machine 5 based on the number of approaches and the approach distance.

Specifically, when the number of approaches is zero, the setting unit 72 sets so as not to stop the operation of the work machine 5. To control the work machine 5, the setting unit 72 further sets to stop the operation of the work machine 5 based on the increased number of approaches and the reduced approach distance. As shown in FIG. 20, the setting unit 72 of the present embodiment sets, together with the range of approach distances and the range of number of approaches described in the second and fourth embodiments, whether or not to stop the operation of the work machine 5. In the present embodiment, the counter 71 counts the number of approaches of a person who enters the regions in association with the identification information of the person.

Similarly to the second embodiment, the determination unit 73 determines in which range of FIG. 20 the approach distance estimated by the identification information recognition device 41 is. Then, the determination unit 73 determines whether or not to stop the operation of the work machine 5 based on the number of approaches and the approach distance for each person who entered the regions R1 to R3.

Furthermore, when a plurality of persons entered the predetermined regions R1 to R3, the determination unit 73 of the present embodiment determines whether or not to stop the operation of the work machine 5 for each of the plurality of persons based on the number of approaches and the approach distance for the person who is in the region. Then, if the determination unit 73 determines to stop the operation of the work machine 5 even for one person, then the determination unit 73 determines to stop the operation of the work machine 5.

The operation stop unit 76 generates a control signal according to the determination by the determination unit 73 whether or not to stop the operation, and outputs the control signal to the operation controller 67 to stop the operation of the work machine 5. In this way, this embodiment does not stop the operation when the number of approaches is small and the approach distance is normal, and stops the operation when the number of approaches is large or the approach distance is very short.

If a person having a large number of approaches is in the normal approach distance from the work machine 5 (within the predetermined region R3), for example, the present embodiment stops the operation of the work machine 5 even when another person having a small number of approaches is within the predetermined region R3. In this way, the present embodiment avoids a contact of the other person with the work machine 5.

Seventh Embodiment

Referring next to FIGS. 21 and 22, the following describes a work machine 5 that is a seventh embodiment of the present invention. The work machine 5 of this embodiment is different from the sixth embodiment in that it includes a limit/alarm controller 70C having both of the functions of the alarm generator 42 according to the first embodiment and of the alarm controller 70A and the limit controller 70B. The other configurations are the same as in the sixth embodiment, and their detailed descriptions are omitted.

FIG. 21 is a block diagram of the controller 7 of the work machine 5 according to the seventh embodiment. In the present embodiment, the work machine 5 includes a distance measurement device that measures the approach distance of a person from the work machine 5 when they enter the region and approach the work machine 5. In the present embodiment, the identification information recognition device 41 measures the approach distance, meaning that the identification information recognition device 41 doubles as the distance measurement device, and the present embodiment is the same in this respect as the identification information recognition device 41 of the work machine 5 in the sixth embodiment.

To control the work machine, the limit/alarm controller 70C of the present embodiment sets the magnitude of an alarm of the alarm generator 42, the amount of reduction in operating speed of the work machine 5, and whether or not to stop the operation of the work machine 5 based on the number of approaches of each person who entered predetermined regions R1 to R3 and their approach distances. Specifically, the present embodiment sets the magnitude of an alarm of the alarm generator 42, the amount of reduction in operating speed of the work machine 5, and whether or not to stop the operation of the work machine 5 for each range of the approach distances.

When the approach distance is normal, the present embodiment sets the magnitude of an alarm of the alarm generator 42 so that it increases with the number of approaches. When the approach distance is normal, whether or not to generate an alarm may be set in accordance with the increase in number of approaches as shown in FIG. 7.

When the approach distance is short, the present embodiment sets the amount of reduction in operating speed of the work machine 5 so that it increases with the number of approaches. When the distance of approaches is very short, this embodiment determines to stop the operation of the work machine 5. Note that even when the distance of approaches is very short, this embodiment may determine not to stop the operation of the work machine 5 if the number of approaches is small. Further, when the approach distance is short or the distance of approaches is very short, this embodiment may also set the magnitude of an alarm and whether or not to generate an alarm as shown in FIGS. 10 and 11.

Similarly to the second embodiment, the determination unit 73 determines in which range of FIG. 22 the approach distance estimated by the identification information recognition device 41 is. Then, the determination unit 73 determines which control shown in FIG. 22 should be performed based on the number of approaches and the approach distance for each person who entered the regions R1 to R3.

Furthermore, when a plurality of persons entered the predetermined regions R1 to R3, the determination unit 73 of the present embodiment determines the way of controlling for each of the plurality of persons based on the number of approaches and the approach distance for the person who is in the region. Then, the determination unit 73 gives priority to the control in the order of stopping the operation of the work machine 5, the magnitude of the reduction in the operation speed of the work machine 5, and the magnitude of an alarm of the alarm generator 42, and transmits an instruction to execute the prioritized control to the alarm control unit 74, the operating speed reduce unit 75, or the operation stop unit 76. This controls any one of generation of an alarm by the alarm generator 42, reduction of the operating speed of the work machine 5, and stopping the operation of the work machine 5. As such, this embodiment eliminates the inconvenience from the operator of the work machine 5 as much as possible while deterring a contact between the work machine 5 and other workers, and suppresses a decrease in productivity of the work machine 5 as stated above.

That is a detailed description of the embodiments of the present invention. The present invention is not limited to the above-stated embodiments, and the design may be modified variously without departing from the spirits of the present invention recited in the claims.

REFERENCE SIGNS LIST

5 Work machine

7 Controller

41 Identification information recognition device (distance measurement device)

42 Alarm generator

The invention claimed is:

1. A work machine comprising:

an identification information recognition device configured to recognize identification information on a person who enters a predetermined region around the work machine;

a distance measurement device configured to measure an approach distance from the work machine of each person who enters the predetermined region and approaches the work machine;

an alarm generator that generates an alarm; and a controller configured to control the work machine, wherein when a person enters the predetermined region under the condition that the work machine is ready for operation, the controller counting the number of times the person enters the predetermined region as the number of approaches for each person distinguished with the identification information, wherein the controller controls the work machine based on the counted number of approaches in accordance with the identification information of the person who is in the predetermined region and the approach distance associated with the identification information of the person who is in the predetermined region, wherein the controller sets a relationship between the number of approaches, the approach distance, and a magnitude of the alarm of the work machine, the relationship being set so that the magnitude of the alarm of the work machine is larger as the number of approaches increases or the approach distance decreases, and wherein to control the work machine, the controller determines the magnitude of the alarm of the work machine for each person who is in the predetermined region based on the relationship, selects a largest value among the magnitudes of the alarm, and controls the alarm generator according to the largest value.

2. The work machine according to claim 1, wherein to control the work machine, the controller controls the alarm generator so as to generate the alarm when the number of approaches is a predetermined number or more.

3. The work machine according to claim 1, wherein to control the work machine, the controller controls the alarm of the alarm generator based on the number of approaches and the approach distance for each person who enters the predetermined region.

4. The work machine according to claim 3, wherein to control the work machine, the controller controls the alarm generator so as to generate the alarm in accordance with an increased number of approaches and a decreased approach distance.

5. The work machine according to claim 1, wherein to control the work machine, the controller limits an operating speed of the work machine based on the number of approaches.

6. The work machine according to claim 5, wherein to control the work machine, the controller slows down the operating speed of the work machine with an increase in the number of approaches.

7. The work machine according to claim 5, wherein to control the work machine, the controller stops the operation of the work machine when the number of approaches is a predetermined number or more.

8. The work machine according to claim 5, wherein to control the work machine, the controller stops the operation of the work machine with an increased number of approaches and a decreased approach distance.

9. The work machine according to claim 1, wherein to control the work machine, the controller limits an operating speed of the work machine based on the number of approaches and the approach distance for each person who enters the predetermined region.

10. The work machine according to claim 9, wherein to control the work machine, the controller slows down the operating speed of the work machine with an increase in the number of approaches or a decrease in the approach distance.

11. The work machine according to claim 1, wherein for a plurality of persons entering the predetermined region, the controller controls the work machine based on a largest number of approaches among the counted numbers of approaches for the plurality of persons.

* * * * *